US008776666B2

(12) United States Patent
Mori

(10) Patent No.: US 8,776,666 B2
(45) Date of Patent: Jul. 15, 2014

(54) HYDRAULIC MOTOR DRIVING DEVICE

(75) Inventor: Satoshi Mori, Sagamihara (JP)

(73) Assignee: Kayaba Industry Co., Ltd., Tokyo (JP)

( * ) Notice: Subject to any disclaimer, the term of this patent is extended or adjusted under 35 U.S.C. 154(b) by 463 days.

(21) Appl. No.: 13/255,493

(22) PCT Filed: Oct. 7, 2010

(86) PCT No.: PCT/JP2010/067654
§ 371 (c)(1),
(2), (4) Date: Sep. 8, 2011

(87) PCT Pub. No.: WO2011/048958
PCT Pub. Date: Apr. 28, 2011

(65) Prior Publication Data

US 2012/0024145 A1 Feb. 2, 2012

(30) Foreign Application Priority Data

Oct. 19, 2009 (JP) ..... 2009-240330

(51) Int. Cl.
*F01B 3/10* (2006.01)
*F03C 1/34* (2006.01)
*F03C 1/40* (2006.01)

(52) U.S. Cl.
CPC ..... *F03C 1/0697* (2013.01); *F03C 1/0615* (2013.01); *F03C 1/0681* (2013.01); *F03C 1/0684* (2013.01); *F03C 1/0686* (2013.01); *F03C 1/0678* (2013.01)
USPC ..... 91/505

(58) Field of Classification Search
USPC ..... 91/504, 505, 506
See application file for complete search history.

(56) References Cited

U.S. PATENT DOCUMENTS

| | | | | | |
|---|---|---|---|---|---|
| 5,649,468 | A * | 7/1997 | Tsurumi et al. | ..... | 91/506 |
| 5,826,488 | A * | 10/1998 | Arai et al. | ..... | 91/506 |
| 6,151,895 | A * | 11/2000 | Matsura | ..... | 92/12.2 |
| 6,880,450 | B2 * | 4/2005 | Stolzer | ..... | 91/506 |
| 6,925,799 | B2 * | 8/2005 | Ju | ..... | 91/506 |

FOREIGN PATENT DOCUMENTS

| | | |
|---|---|---|
| DE | 10041435 A1 | 8/2001 |
| JP | 52-98041 U | 7/1977 |
| JP | 1-124404 U | 8/1989 |
| JP | 7-054757 A | 2/1995 |
| JP | 08-219004 A | 8/1996 |

OTHER PUBLICATIONS

German Office Action dated Mar. 22, 2013 with English translation.

* cited by examiner

*Primary Examiner* — Michael Leslie
(74) *Attorney, Agent, or Firm* — Rabin & Berdo, P.C.

(57) ABSTRACT

A motor capacity change-over actuator 10 varies a capacity of a hydraulic motor 1 in accordance with the inflow/outflow of a working fluid into/out of a drive pressure chamber 72. A motor capacity change-over valve 20 supplies the working fluid to the drive pressure chamber 72 in a supply position H and discharges the working fluid from the drive pressure chamber 72 in a discharge position L. A flow control valve 15 is interposed between the drive pressure chamber 72 and the motor capacity change-over valve 20, and therefore a shock generated upon deceleration of the hydraulic motor 1 can be alleviated without being affected by leakage of the working fluid in the motor capacity change-over valve 20.

7 Claims, 8 Drawing Sheets

HYDRAULIC MOTOR DRIVING DEVICE

FIELD OF THE INVENTION

This invention relates to a driving device for a hydraulic motor, which comprises a motor capacity change-over actuator.

BACKGROUND OF THE INVENTION

JP08-219004A, published by the Japan Patent Office in 1996, proposes a driving device for a swash plate hydraulic motor used to generate travel power for a hydraulic shovel.

Referring to FIG. 8, this driving device comprises a motor capacity change-over actuator 93 that changes a tilt angle of a swash plate of a hydraulic motor 91 and a motor capacity change-over valve 95 that changes a working fluid pressure for driving the motor capacity change-over actuator 93.

In a high speed position X, the motor capacity change-over valve 95 supplies a pressurized working fluid in a high pressure port 94B to the motor capacity change-over actuator 93. The motor capacity change-over actuator 93 is driven to expand by the pressurized working fluid such that the tilt angle of a swash plate 92 of the hydraulic motor 91 decreases. As a result, a rotation speed of the hydraulic motor 91 increases.

To decelerate the hydraulic motor 91, the motor capacity change-over valve 95 is changed over from the high speed position X to a low speed position Y. In the low speed position Y, a tank port 94C communicates with the motor capacity change-over actuator 93. The motor capacity change-over actuator 93 is operated by a reactive force from the swash plate 92 to contract while discharging the working fluid to a tank 100. As a result, the tilt angle of the swash plate 92 of the hydraulic motor 91 increases, leading to a reduction in the rotation speed of the hydraulic motor 91.

A flow control valve 98 constituted by a fixed orifice 96 and a pressure reducing valve 97 is provided between the motor capacity change-over valve 95 and the tank port 94C.

The flow control valve 98 keeps a flow rate of the working fluid that is discharged from the motor capacity change-over actuator 93 to the tank 100 via the tank port 94C during deceleration of the hydraulic motor 91 substantially constant. By keeping a contraction operation speed of the motor capacity change-over actuator 93 constant using the flow control valve 98, a shock generated as the hydraulic motor 91 decelerates is alleviated.

SUMMARY OF THE INVENTION

In this hydraulic motor driving device, the flow control valve 98 is provided between the motor capacity change-over valve 95 and the tank port 94C. When an upstream side of the flow control valve 98 reaches a high pressure during deceleration of the hydraulic motor 91, a part of the working fluid leaks into a drain through a gap in the motor capacity change-over valve 95. This working fluid leakage may cause the contraction speed of the motor capacity change-over actuator 93 to rise, thereby inhibiting alleviation of the shock generated as the hydraulic motor 91 decelerates.

It is therefore an object of this invention to provide a hydraulic motor driving device that is capable of sufficiently alleviating a shock generated when a hydraulic motor decelerates.

To achieve the object described above, this invention provides a hydraulic motor driving device that varies a capacity of a hydraulic motor using a working fluid, comprising a motor capacity change-over actuator. The motor capacity change-over actuator includes a drive pressure chamber that varies the capacity of the hydraulic motor in accordance with supply and discharge of the working fluid. The hydraulic motor driving device further comprises a motor capacity change-over valve that changes between a supply position in which the working fluid is supplied to the drive pressure chamber and a discharge position in which the working fluid is discharged from the drive pressure chamber, and a flow control valve that is disposed between the drive pressure chamber and the motor capacity change-over valve to adjust a flow rate of the working fluid discharged from the drive pressure chamber.

The details as well as other features and advantages of this invention are set forth in the remainder of the specification and are shown in the accompanying drawings.

DESCRIPTION OF THE PREFERRED EMBODIMENTS

Figure 1:
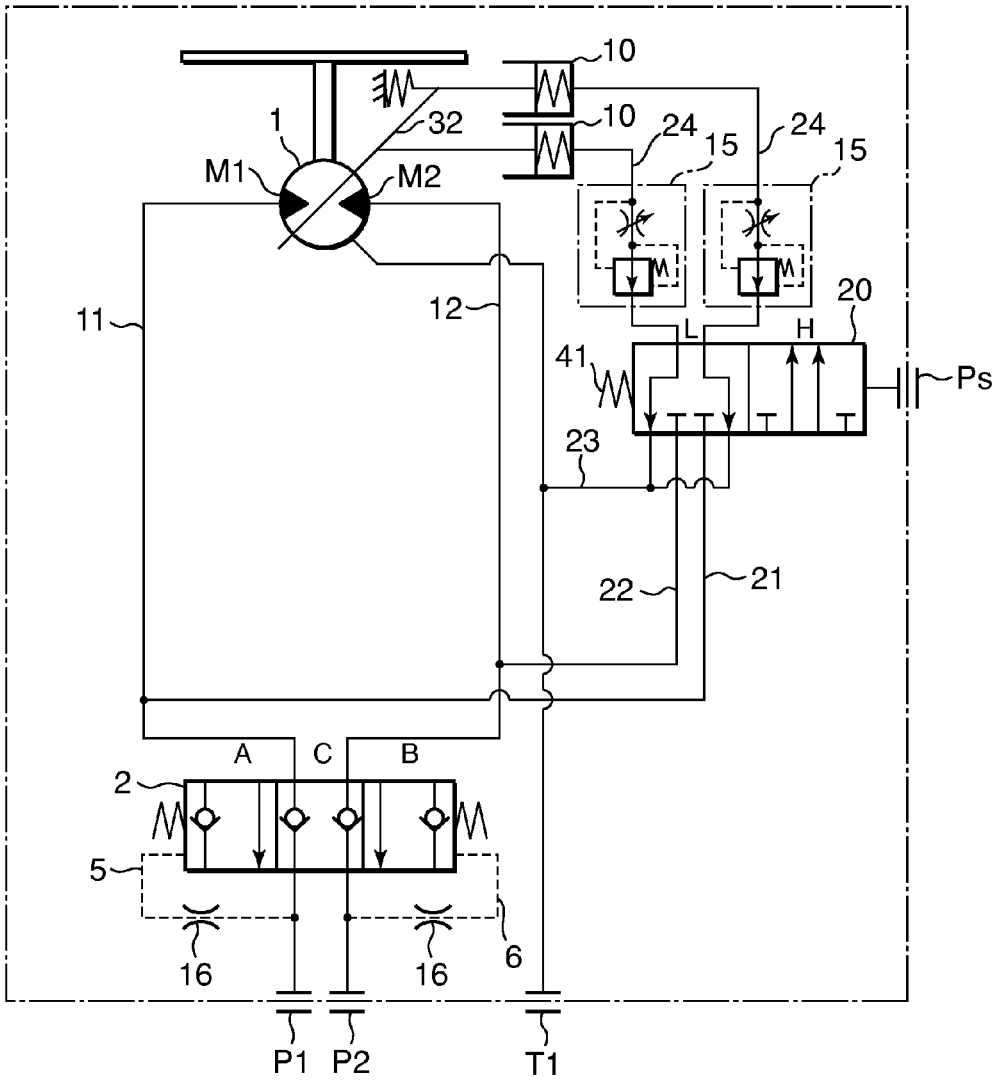
FIG. 1 is a hydraulic circuit diagram of a hydraulic motor driving device according to this invention.

Referring to FIG. 1 of the drawings, a swash plate type variable capacity hydraulic motor 1 installed in a hydraulic shovel as a travel power source is operated by an oil pressure supplied selectively to ports P1 and P2 formed in a hydraulic motor driving device. An aqueous solution may be used instead of working oil.

The hydraulic motor driving device includes a main passage 11 linking a motor port M1 of the hydraulic motor 1 to the port P1, and a main passage 12 linking a motor port M2 of the hydraulic motor 1 to the port P2.

The hydraulic motor 1 is rotated in a positive rotation direction by working oil supplied from the port P1 to the motor port M1 through the main passage 11, whereby the hydraulic shovel is caused to advance via a traveling device. Further, the hydraulic motor 1 is rotated in a negative rotation direction by working oil supplied from the port P2 to the motor port M2 through the main passage 12, whereby the hydraulic shovel is caused to reverse via the traveling device.

A counterbalance valve 2 is interposed on the main passages 11 and 12. The counterbalance valve 2 operates in accordance with a pressure balance between pilot pressures led respectively from the ports P1 and P2 through pilot passages 5 and 6.

When the hydraulic motor 1 rotates in the positive direction, pressurized working oil is supplied to the port P1. The pressurized working oil is led to the pilot passage 5, and therefore the counterbalance valve 2 is maintained in a positive rotation position A. When the hydraulic motor 1 rotates in the negative direction, pressurized working oil is supplied to the port P2. The pressurized working oil is led to the pilot passage 6, and therefore the counterbalance valve 2 is maintained in a negative rotation position B.

When the hydraulic motor 1 is inoperative, the ports P1 and P2 are both held at a low pressure. Since the pilot pressures led from the ports P1 and P2 through the pilot passages 5 and 6 are both low, the counterbalance valve 2 is changed over to a stop position C, and as a result, the main passages 11 and 12 are closed.

Fixed orifices 16 are interposed respectively in the pilot passages 5 and 6. When the counterbalance valve 2 changes over from the position A or B to the stop position C, the fixed orifice 16 applies resistance to a flow of working oil that is discharged to a drain through the pilot passage 5 or the pilot passage 6. The resistance applied to the discharged working oil by the fixed orifice 16 reduces a change-over speed of the counterbalance valve 2 such that the hydraulic motor 1 is stopped gently from a positive rotation condition or a negative rotation condition.

The variable capacity hydraulic motor 1 includes a swash plate 32, and a pair of motor capacity change-over actuators 10 for varying a tilt angle of the swash plate 32, or in other words a pump capacity. By varying the tilt angle of the swash plate 32, the respective motor capacity change-over actuators 10 vary a displacement volume of a piston of the hydraulic motor 1 in two stages. As a result, a rotation speed of the hydraulic motor 1 is varied between a low speed and a high speed.

Working oil is supplied to the respective motor capacity change-over actuators 10 via a motor capacity change-over valve 20.

A branch passage 21 branching from the main passage 11, a branch passage 22 branching from the main passage 12, a drain passage 23 communicating with a tank port T1, and a pair of actuator passages 24 communicating with the pair of motor capacity change-over actuators 10 are connected to the motor capacity change-over valve 20.

The motor capacity change-over valve 20 changes between two positions, namely a high speed position H and a low speed position L, in accordance with a pilot pressure in a pilot port PS. The pilot pressure in the pilot port PS biases the motor capacity change-over valve 20 toward the high speed position H. Meanwhile, the motor capacity change-over valve 20 is biased toward the low speed position L by a spring 41.

When the pilot pressure in the pilot port PS is low, the motor capacity change-over valve 20 is held in the low speed position L by a biasing force of the spring 41. In the low speed position L, the motor capacity change-over valve 20 connects the pair of actuator passages 24 to the drain passage 23. When the pair of actuator passages 24 are connected to the drain passage 23, the motor capacity change-over actuators 10 supporting the swash plate 32 are held in a contraction position by a reactive force received from the swash plate 32. As a result, the swash plate 32 maintains a large tilt angle such that the hydraulic motor 1 rotates at a low speed.

When the pilot pressure in the pilot port PS is high, the motor capacity change-over valve 20 is held in the high speed position H against the biasing force of the spring 41. In the high speed side position H, the motor capacity change-over valve 20 connects the pair of actuator passages 24 to the branch passages 21 and 22. Pressurized working oil supplied through the actuator passage 24 from the branch passage 21 or the branch passage 22 drives one of the motor capacity change-over actuators 10 to expand. As a result, the tilt angle of the swash plate 32 decreases such that the hydraulic motor 1 rotates at a high speed.

The motor capacity change-over valve 20 changes between the low speed position L and the high speed position H in accordance with variation in the pilot pressure in the pilot port PS. The high speed position H corresponds to a supply position for supplying working oil to the motor capacity change-over actuator 10, while the low speed position L corresponds to a discharge position for discharging the working oil from the motor capacity change-over actuator 10.

Incidentally, if the pair of motor capacity change-over actuators 10 contract at high speed during an operation to decelerate the hydraulic motor 1, the rotation speed of the hydraulic motor 1 decreases rapidly, and as a result, a deceleration shock is generated.

In the hydraulic motor driving device, a flow control valve 15 is provided in each actuator passage 24 to prevent this deceleration shock. The flow control valve 15 ensures that the rotation speed of the hydraulic motor 1 decreases gently by suppressing a flow rate of the working oil discharged from the corresponding motor capacity change-over actuator 10 to or below a fixed rate.

Figure 2:
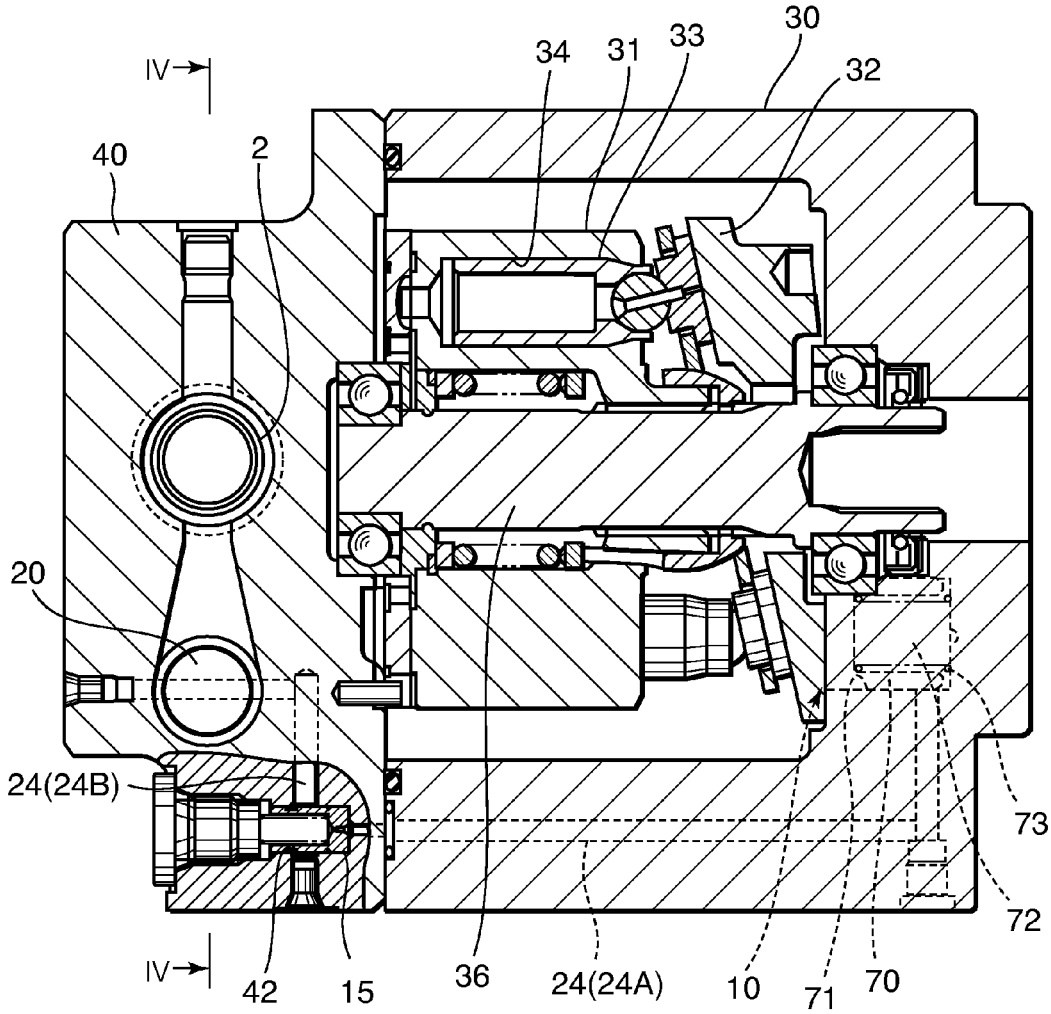
FIG. 2 is a longitudinal sectional view of a hydraulic motor to which the hydraulic motor driving device according to this invention is applied.

Referring to FIG. 2, the constitution of the hydraulic motor 1 will be described.

The hydraulic motor 1 includes an interior space defined by a motor casing 30 and a port block 40. A cylinder block 31 and the swash plate 32 are accommodated in the interior space.

The cylinder block 31 is fixed to an outer periphery of a rotary shaft 36 supported by the motor casing 30 and the port block 40. A plurality of cylinders 34 disposed parallel to the rotary shaft 36 are formed in the cylinder block 31 at equal angular intervals in a circumferential direction. A piston 33 is accommodated in each cylinder 34. The piston 33 is held in contact with the swash plate 32 via a shoe.

Pressurized working oil is supplied to each cylinder 34 from the main passage 11 or 12 in FIG. 1. The pressurized working oil supplied to the cylinder 34 drives the piston 33 to expand and contract in an axial direction relative to the cylinder 34. By operating the plurality of pistons 33 held in contact with the swash plate 32 to expand and contract successively in accordance with predetermined rotary angle positions, the cylinder block 31 is driven to rotate. The rotary shaft 36 rotates integrally with the cylinder block 31, and a resulting rotary torque is output as power for causing the hydraulic shovel to travel.

The cylinder block 31 completes a single revolution when all of the pistons 33 complete a single reciprocation within the cylinders 34.

The swash plate 32 is supported on the motor casing 30 to be capable of tilting via a pair of ball bearings. The swash plate 32 is driven by the pair of motor capacity change-over actuators 10 such that the tilt angle thereof is varied. The swash plate 32 is changed over between two positions, namely a maximum tilt angle corresponding to the low speed position and a minimum tilt angle corresponding to the high speed position. The figure shows the swash plate 32 at the maximum tilt angle.

The motor capacity change-over actuator 10 includes a drive piston 70 having a closed-end cylindrical shape. The drive piston 70 is accommodated to be free to slide within a cylinder 71 formed in the motor casing 30.

A drive pressure chamber 72 is defined between the cylinder 71 and the drive piston 70. The actuator passage 24 is connected to the drive pressure chamber 72.

A compressed spring 73 for biasing the swash plate 32 in a tilt angle reduction direction via the drive piston 70 is disposed in the drive pressure chamber 72. The drive piston 70 is pressed against a back surface of the swash plate 32 at all times by a biasing force of the spring 73.

The pressurized working oil led from the branch passages 21 and 22 in FIG. 1 is introduced into the drive pressure chamber 72 through the actuator passages 24. The drive piston 70 is caused to project from the cylinder 71 by a working oil pressure in the drive pressure chamber 72, thereby pressing the back surface of the swash plate 32 toward the high speed position together with the biasing force of the spring 73. Meanwhile, a pressing force exerted on the swash plate 32 by the respective pistons 33 biases the swash plate 32 toward the low speed position. Thus, the swash plate 32 displaces between the high speed position and the low speed position in accordance with the working oil pressure in the drive pressure chamber 72. When the tilt angle of the swash plate 32 is changed over between the high speed position and the low speed position, a stroke distance of the pistons 33 reciprocating within the cylinders 34 varies, and as a result, a rotation speed of the cylinder block 31 varies.

Figure 4:
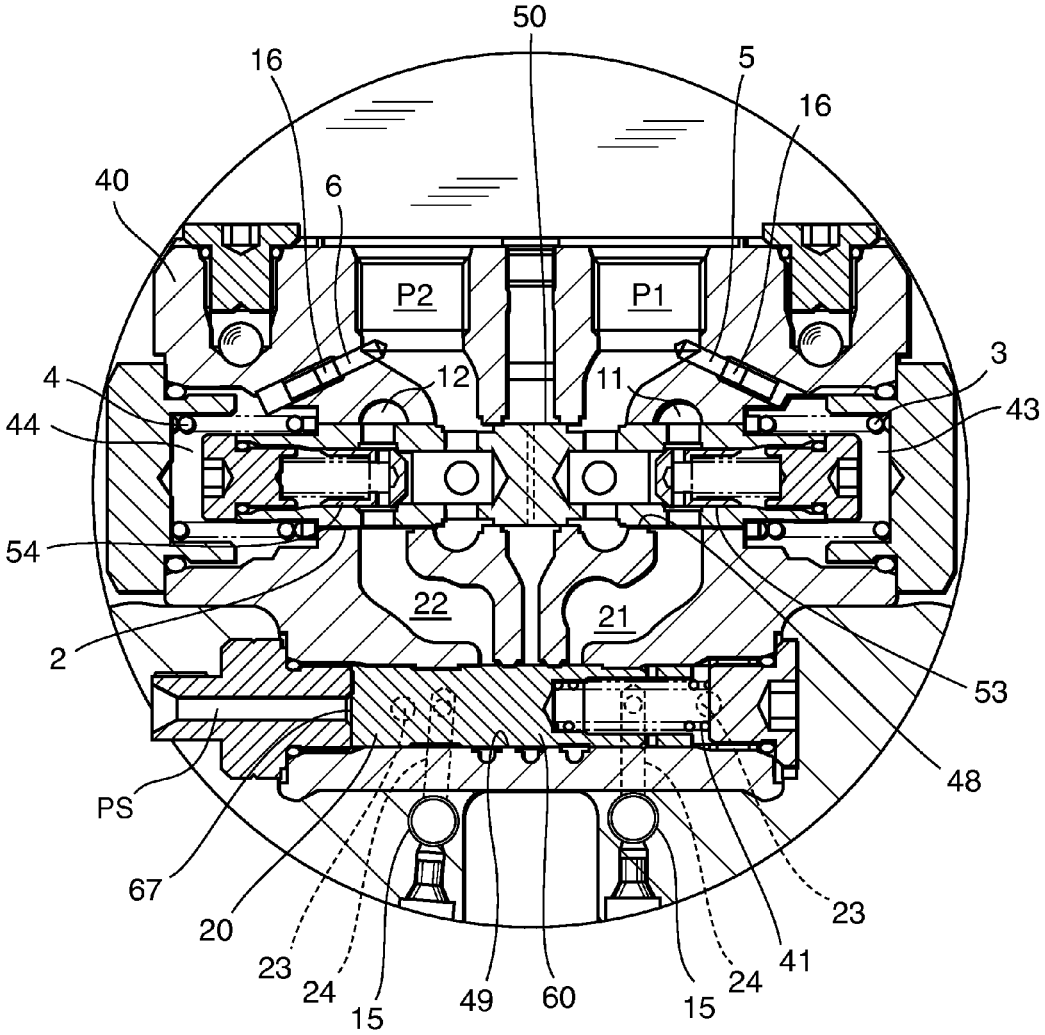
FIG. 4 is a longitudinal sectional view taken along a IV-IV line in FIG. 2, showing the flow control valve and a counterbalance valve according to this invention.

Referring to FIG. 4, the counterbalance valve 2, the motor capacity change-over valve 20, and the pair of flow control valves 15 are accommodated in the integrated port block 40.

The counterbalance valve 2 is interposed between the ports P1 and P2 formed in the port block 40 and the main passages 11 and 12. In the port block 40, the branch passage 21 branches from the main passage 11 and the branch passage 22 branches from the main passage 12. The motor capacity change-over valve 20 is provided between the branch passages 21 and 22 and the pair of actuator passages 24 formed in the port block 40. The flow control valve 15 is provided at a midway point on each actuator passage 24.

The counterbalance valve 2 includes a spool 50 that is accommodated to be free to slide in a valve hole 48 formed in the port block 40. Pilot pressure chambers 43 and 44 are formed in the port block 40 to face respective ends of the spool 50.

When the hydraulic motor 1 is operated to rotate positively or negatively, a pressure in the high pressure side port P1 or P2 is led to the pilot pressure chamber 43 or the pilot pressure chamber 44 through the pilot passage 5 or the pilot passage 6. The spool 50 displaces from the stop position C to an operating position A or an operating position B in accordance with the pilot pressure led to the pilot pressure chamber 43 or the pilot pressure chamber 44. As a result, the port P1 and the port P2 communicate with the main passage 11 and the main passage 12, respectively. The fixed orifices 16 are interposed respectively in the pilot passage 5 and the pilot passage 6.

A spring 3 that biases the spool 50 toward the stop position C is accommodated in the pilot pressure chamber 43. A spring 4 that biases the spool 50 toward the stop position C is accommodated in the pilot pressure chamber 44. The spool 50 is maintained in the stop position C shown in the figure by respective biasing forces of the springs 3 and 4 when the pilot pressure is not exerted thereon. In the stop position C, working oil outflow from the main passages 11 and 12 is blocked.

Check valves 53 and 54 forming a part of the counterbalance valve 2 are accommodated in the spool 50. When the spool 50 is positioned in the stop position C, the check valve 53 permits a flow of working oil from the port P1 to the motor port M1 but blocks a reverse flow. Likewise when the spool 50 is positioned in the stop position C, the check valve 54 permits a flow of working oil from the port P2 to the motor port M2 but blocks a reverse flow.

The motor capacity change-over valve 20 includes a motor capacity change-over spool 60 accommodated to be capable of sliding in a valve hole 49 formed in the port block 40.

A motor capacity change-over pilot pressure chamber 67 is defined in the valve hole 49 to face one end of the motor capacity change-over spool 60. Another end of the motor capacity change-over spool 60 is elastically supported by the spring 41. The spring 41 biases the motor capacity change-over spool 60 toward the low speed side position L.

When the pilot pressure led into the motor capacity change-over pilot pressure chamber 67 from the pilot port PS increases, the motor capacity change-over spool 60 displaces rightward in the figure against the spring 41, whereby the motor capacity change-over valve 20 is changed over from the low speed side position L to the high speed side position H. In the high speed side position H, the branch passage 21 and one of the actuator passages 24 communicate via an annular groove formed in an outer periphery of the motor capacity change-over spool 60.

Further, the branch passage 22 and the other actuator passage 24 communicate via another, similar annular groove. As a result, pressurized working oil is supplied to one of the pair of motor capacity change-over actuators 10. The motor capacity change-over actuator 10 to which the pressurized working oil is supplied expands, thereby reducing the tilt angle of the swash plate 32, and as a result, the rotation speed of the hydraulic motor 1 increases.

When the pilot pressure led into the motor capacity change-over pilot pressure chamber 67 from the pilot port PS decreases, the motor capacity change-over spool 60 is displaced leftward in the figure by a biasing force of the spring 41, whereby the motor capacity change-over valve 20 is changed over from the high speed side position H to the low speed side position L. As a result, communication between the branch passages 21 and 22 and the actuator passages 24 is blocked, and the pair of actuator passages 24 communicate respectively with the drain passage 23.

In the low speed side position L, the working oil in the respective motor capacity change-over actuators 10 flows out into the drain passage 23 through the actuator passages 24. The respective motor capacity change-over actuators 10 thereby contract, causing the tilt angle of the swash plate 32 to increase, and as a result, the rotation speed of the hydraulic motor 1 decreases.

Figure 3A:
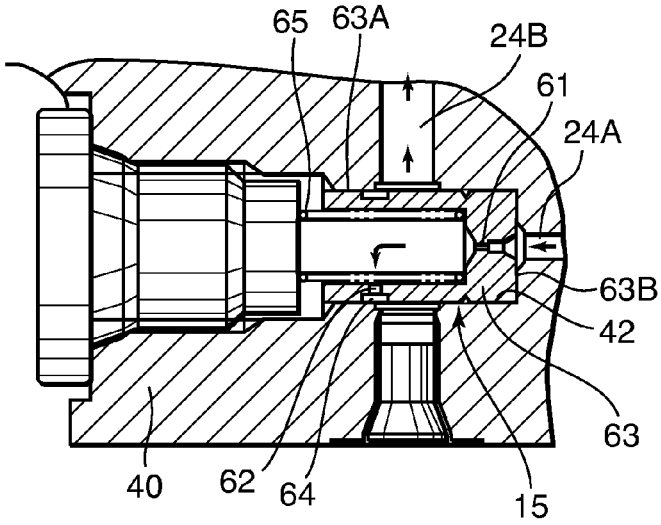
FIG. 3A is a longitudinal sectional view of essential parts of a flow control valve in a fully open position, according to this invention.
Figure 3B:
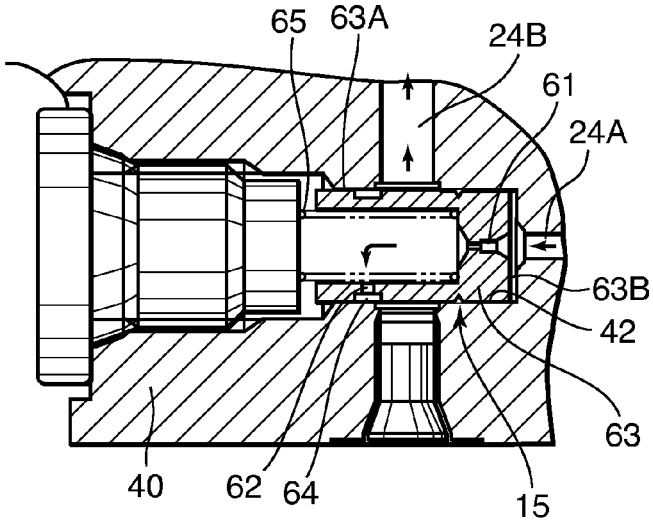
FIG. 3B is a longitudinal sectional view of the essential parts of the flow control valve in an intermediate position
Figure 3C:
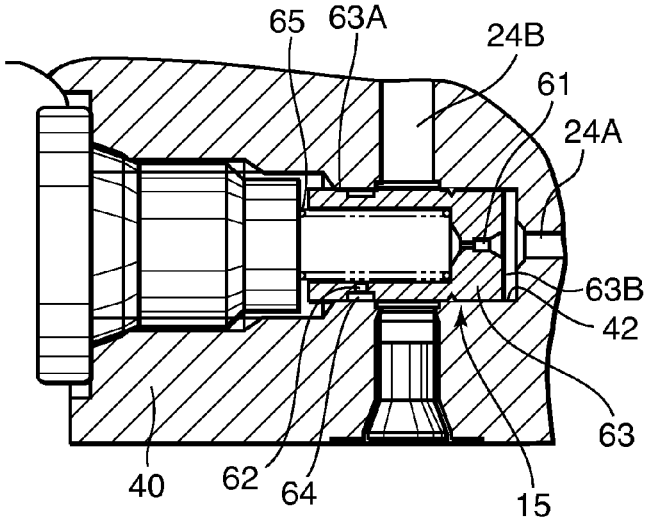
FIG. 3C is a longitudinal sectional view of the essential parts of the flow control valve in a blocked position.

Referring to FIGS. 3A-3C, the flow control valve 15 interposed in the actuator passage 24 includes a flow control spool 63 interposed to be capable of sliding in a valve hole 42 formed in the port block 40. For ease of description, a part of the actuator passage 24 between the flow control valve 15 and the motor capacity change-over actuator 10 will be referred to hereafter as a passage 24A, and a part between the flow control valve 15 and the motor capacity change-over valve 20 will be referred to as a passage 24B.

The flow control spool 63 is formed in a cylindrical shape constituted by a cylindrical wall 63A and a bottom portion 63B formed on one end of the cylindrical wall 63A. A metering orifice 61, a through hole 62, and an annular groove 64 are formed in the flow control spool 63. The metering orifice 61 penetrates a center of the bottom portion 63B of the flow control spool 63 such that the passage 24A communicates with an inside of the flow control spool 63 by a small flow sectional area at all times. The flow control spool 63 is biased rightward in the figure, or in other words toward the passage 24A, by a spring 65.

The annular groove 64 is formed in an outer periphery of the cylindrical wall 63A of the flow control spool 63. The through hole 62 penetrates the cylindrical wall 63A to connect the inside of the flow control spool 63 to the annular groove 64.

The passage 24B extending to the motor capacity change-over valve 20 is formed in the port block 40 to face the cylindrical wall 63A of the flow control spool 63.

A pressure in the passage 24A acts on the bottom portion 63B of the flow control spool 63 on the periphery of the metering orifice 61. A pressure on the inside of the flow control spool 63 and an elastic supporting force of the spring 65 act on the flow control spool 63 in an opposite direction to the aforementioned pressure. The flow control spool 63 slides within the valve hole 42 in accordance with a differential pressure between the passage 24B and the passage 24A, or in other words a pressure loss of the metering orifice 61.

Referring to FIG. 3A, when the pressure in the passage 24A is low, the flow control spool 63 is in a rightmost position of the figure. When the flow control spool 63 is in this position, working oil can flow between the passage 24A and the passage 24B via the metering orifice 61, the through hole 62, and the annular groove 64, as shown by an arrow in the figure, for example. This position of the flow control spool 63 will be referred to as a fully open position of the flow control valve 15. When the flow control valve 15 is in the fully open position, flow resistance thereof is generated by the metering orifice 61.

Referring to FIG. 3C, when the pressure in the passage 24A is high, the flow control spool 63 moves to a leftmost position in the figure against the spring 65. When the flow control spool 63 is in this position, communication between the annular groove 64 and the passage 24B is blocked. As a result, the flow of working oil through the actuator passage 24 is blocked. This position will be referred to as a blocked position.

Referring to FIG. 3B, when the flow control spool 63 is positioned between the fully open position and the blocked position, the working oil can flow between the passage 24A and the passage 24B at a limited flow rate.

When the flow control valve 15 is in this position, flow resistance is generated in accordance with a flow sectional area of the working oil between the annular groove 64 and the passage 24B. The flow sectional area between the annular groove 64 and the passage 24B decreases as the pressure in the passage 24A increases. Further, as the pressure in the passage 24B increases, a working oil pressure on the inside of the flow control spool 63 rises, leading to an increase in the flow sectional area between the annular groove 64 and the passage 24B.

When the motor capacity change-over valve 20 is in the H position, the pressure in the passage 24B is high and the flow control valve 15 is in the fully open position. In this case, pressurized working oil is supplied from the branch passage 21 or 22 to the motor capacity change-over actuator 10 via the annular groove 64, the through hole 62, the metering orifice 61, and the passage 24A. As a result, the motor capacity change-over actuator 10 expands, causing the tilt angle of the swash plate 32 to decrease.

When the motor capacity change-over valve 20 is in the L position, the pressure in the passage 24B is lower than when the motor capacity change-over valve 20 is in the H position, and therefore the flow control valve 15 is held in a position for displacing the flow control spool 63 in a closing direction from the fully open position, as shown in FIG. 3B.

In this state, the motor capacity change-over actuator 10 is caused to contract by the reactive force exerted on the motor capacity change-over actuator 10 by the swash plate 32. As a result, the working oil in the motor capacity change-over actuator 10 flows out into the drain passage 23 through the actuator passage 24 and the motor capacity change-over valve 20.

In the flow control valve 15 interposed in the actuator passage 24, working oil flows from the passage 24A to the passage 24B via the metering orifice 61, the through hole 62, and the annular groove 64, and as a result, flow resistance corresponding to the flow sectional area between the annular groove 64 and the passage 24B is generated. The flow sectional area narrows as the pressure in the passage 24A increases, and therefore the flow rate of the working oil that flows out of the motor capacity change-over actuator 10 into the drain passage 23 through the actuator passage 24 is suppressed to or below a fixed rate.

By having the flow control valve 15 hold the flow rate of the working oil that flows out of the motor capacity change-over actuator 10 into the drain passage 23 through the actuator passage 24 at or below a fixed rate in this manner, a speed at which the tilt angle of the swash plate 32 is increased by the motor capacity change-over actuator 10 is suppressed to or below a fixed speed. As a result, shock generation can be prevented during deceleration of the hydraulic motor 1.

The flow control valve 15 is disposed between the motor capacity change-over actuator 10 and the motor capacity change-over valve 20, and therefore the motor capacity change-over valve 20 is positioned downstream of the flow control valve 15 relative to the flow of working oil flowing out from the motor capacity change-over actuator 10. A part of the working oil flowing out of the motor capacity change-over actuator 10 may leak into a drain through a gap between the motor capacity change-over spool 60 of the motor capacity change-over valve 20 and the valve hole 49. However, this working oil leakage in the motor capacity change-over valve 20 does not affect a contraction speed of the motor capacity change-over actuator 10, and therefore the shock generated by the flow control valve 15 during deceleration of the hydraulic motor 1 can be alleviated sufficiently.

When the motor capacity change-over valve 20 changes over from the low speed side position L to the high speed side position H such that the pressurized working oil led from the branch passage 21, 22 flows into the motor capacity change-over actuator 10, the flow control valve 15 shifts to the fully open position such that the flow sectional area for the working oil between the through hole 62 and the annular groove 64 reaches a maximum. Accordingly, the pressurized working oil supplied to the port P1 (P2) flows rapidly into the motor capacity change-over actuator 10 via the branch passage 21 (22) and the actuator passage 24, thereby securing acceleration responsiveness in the hydraulic motor 1.

The flow control valve 15 is structured such that the flow sectional area of the working oil narrows as the pressure in the passage 24A increases, and therefore a maximum value of the flow sectional area can be set to be larger than the fixed orifice. As a result, the effects of working oil contamination can be suppressed, and a favorable characteristic can be maintained in the long term.

Figure 5:
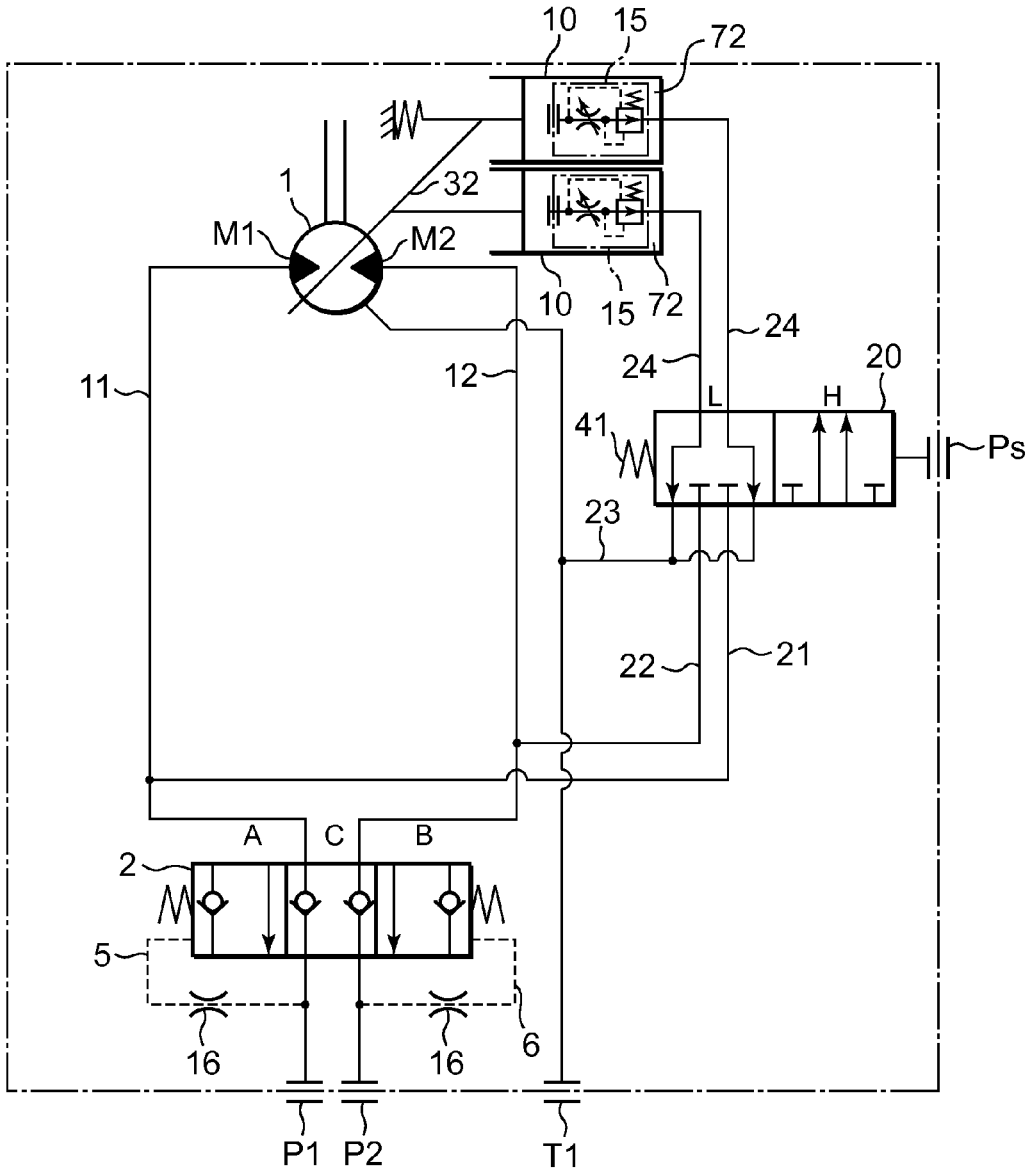
FIG. 5 is similar to FIG. 1, but shows a second embodiment of this invention.
Figure 6:
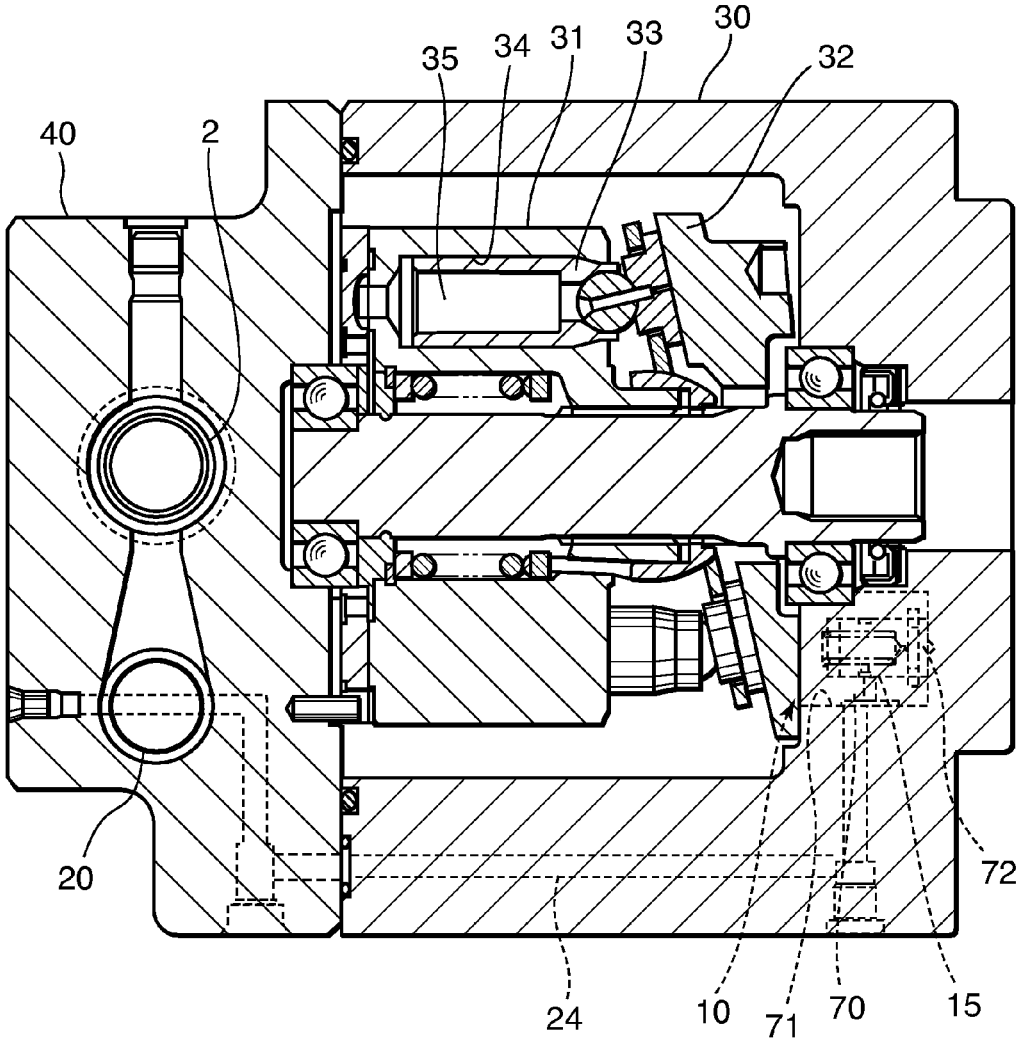
FIG. 6 is a longitudinal sectional view of a hydraulic motor to which a hydraulic motor driving device according to the second embodiment of this invention is applied.
Figure 7:
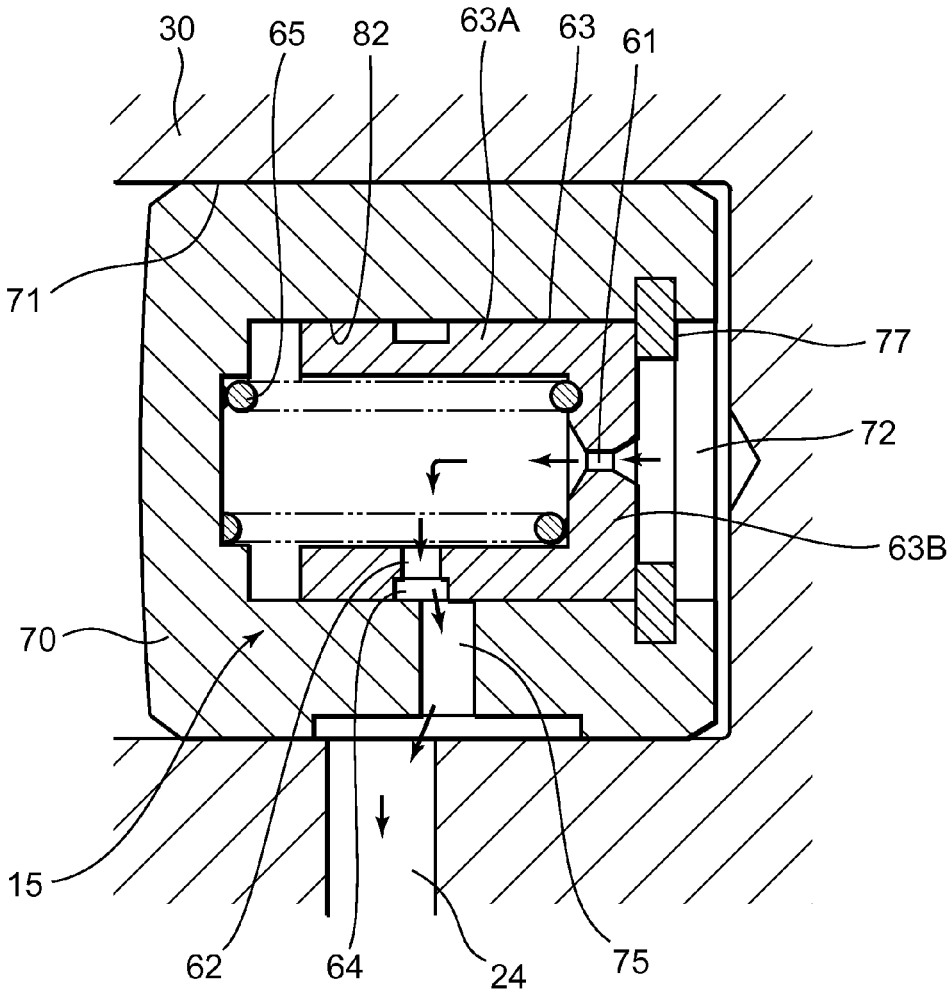
FIG. 7 is a longitudinal sectional view of essential parts of a flow control valve according to the second embodiment of this invention.
Figure 8:
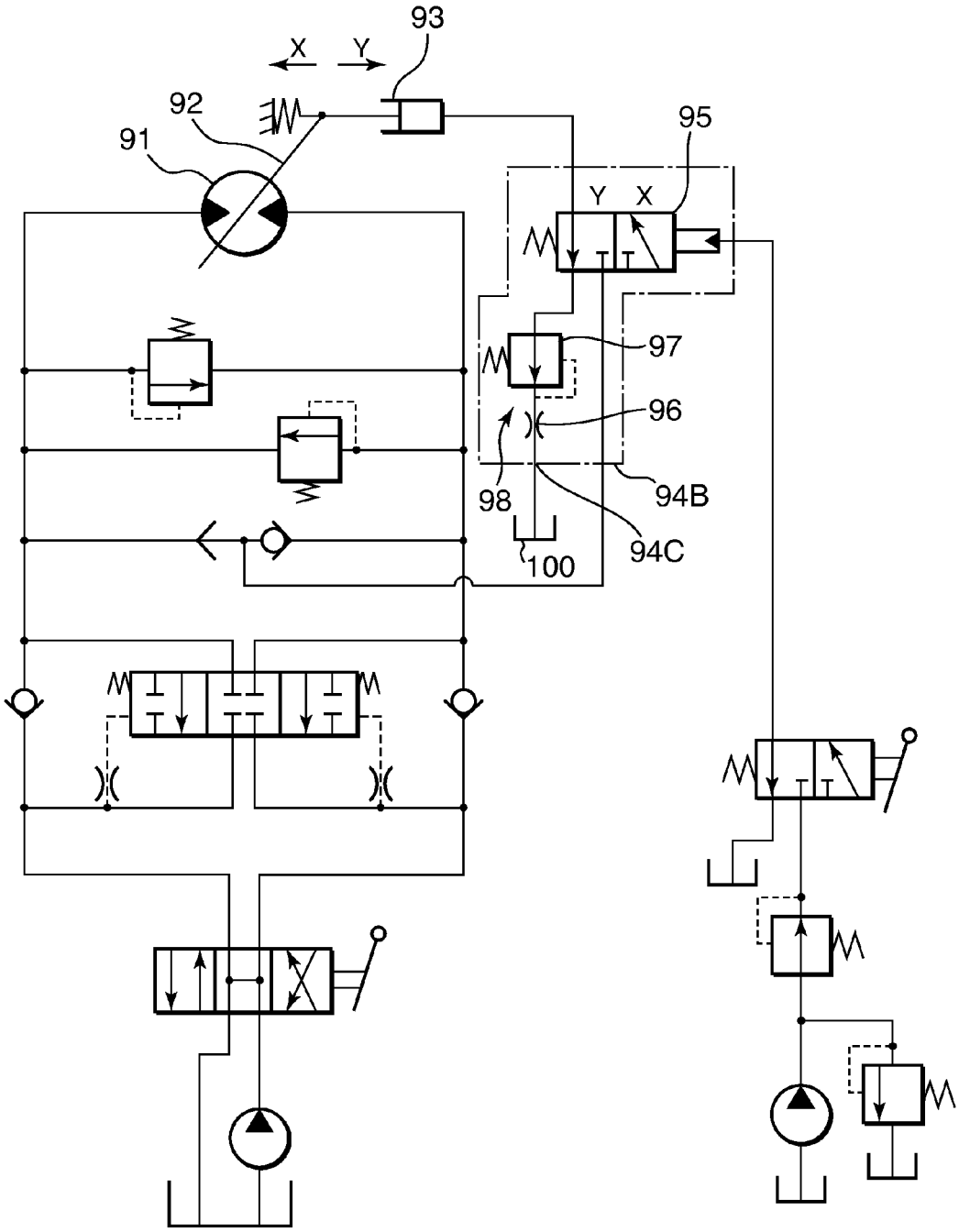
PRIOR ART FIG. 8
FIG. 8 is a hydraulic circuit diagram showing a hydraulic motor driving device according to the prior art.

Referring to FIGS. 5-7, a second embodiment of this invention will be described.

Referring to FIGS. 5 and 6, in a hydraulic motor driving device according to this embodiment, the flow control valve 15 is built into the motor capacity change-over actuator 10.

Referring to FIG. 7, the flow control spool 63 of the flow control valve 15 is accommodated to be free to slide in a valve hole 82 formed in the drive piston 70 of the motor capacity change-over actuator 10. Similarly to the first embodiment, the flow control spool 63 is formed in a cylindrical shape constituted by the cylindrical wall 63A and the bottom portion 63B. Similarly to the first embodiment, the metering orifice 61, the through hole 62, and the annular groove 64 are formed in the flow control spool 63. The flow control spool 63 is elastically supported so as to be oriented toward the drive pressure chamber 72 by a spring 65 that is supported by the drive piston 70. A stopper 77 that restricts displacement of the flow control spool 63 in the direction of the drive pressure chamber 72 is fixed to the valve hole 82.

A port 75 is formed in the driving piston 70 in a position that overlaps the annular groove 64. The actuator passage 24, which communicates with the port 75 at all times regardless of a sliding position of the driving piston 70, is formed in the motor casing 30.

The flow control spool 63 slides within the valve hole 82 in accordance with a differential pressure between the drive pressure chamber 72 and the port 75, or in other words the pressure loss of the metering orifice 61. A flow sectional area between the annular groove 64 and the port 75 varies in accordance with a sliding position of the flow control spool 63 within the valve hole 82. More specifically, when the flow control pool 63 is in a position shown in the figure, i.e. in contact with the stopper 77, the flow sectional area between the annular groove 64 and the port 75 reaches a maximum. The flow sectional area between the annular groove 64 and the port 75 then decreases as the flow control spool 63 slides through the driving piston 70 in an axial direction from this position so as to compress the spring 65.

When the driving piston 70 of the motor capacity change-over actuator 10 receives the reactive force of the swash plate 32 so as to displace in a direction for increasing the tilt angle, or in other words a direction for reducing the rotation speed of the hydraulic motor 1, the drive pressure chamber 72 contracts such that the working oil flows out of the drive pressure chamber 72 into the drain passage 23 via the actuator passage 24 and the motor capacity change-over valve 20 in the low speed position L.

At this time in the flow control valve 15, as shown by an arrow in the figure, the working oil that flows to the inside of the flow control spool 63 from the drive pressure chamber 72 via the metering orifice 61 flows out into the actuator passage 24 via the through hole 62, the annular groove 64, and the port 75.

As the pressure of the working oil in the drive pressure chamber 72 rises, the flow control spool 63 displaces in the direction for compressing the spring 65. As a result, the flow sectional area between the annular groove 64 and the port 75 decreases. The flow sectional area narrows as the pressure in the drive pressure chamber 72 increases, and therefore the flow rate of the working oil that flows out of the motor capacity change-over actuator 10 into the drain passage 23 through the actuator passage 24 is suppressed to or below a fixed rate, whereby the speed with which the tilt angle of the swash plate 32 increases is suppressed to or below a fixed speed.

In this embodiment also, similarly to the first embodiment, the shock that is generated during deceleration of the hydraulic motor 1 can be alleviated sufficiently without being affected by leakage of the working oil in the motor capacity change-over valve 20.

Furthermore, in this embodiment, the flow control valve 15 is built into the motor capacity change-over actuator 10, and therefore the flow control valve 15 and the motor capacity change-over actuator 10 can be formed as a single unit, enabling a reduction in the number of components constituting the hydraulic motor driving device.

The contents of Tokugan 2009-240330, with a filing date of Oct. 19, 2009 in Japan, are hereby incorporated by reference.

Although the invention has been described above with reference to certain embodiments, the invention is not limited to the embodiments described above. Modifications and variations of the embodiments described above will occur to those skilled in the art, within the scope of the claims.

For example, in the above embodiments, a hydraulic motor driving device that uses working oil was described, but this invention may also be applied to a driving device for a hydraulic motor that uses various types of working fluids other than working oil.

The hydraulic motor driving device according to the above embodiments is used on the swash plate type hydraulic motor 1, but this invention may also be applied to a driving device for any type of hydraulic motor that can be subjected to capacity variation using an actuator.

The hydraulic motor driving device according to the above embodiments is used on the bidirectional rotation type hydraulic motor 1 including the pair of motor capacity change-over actuators 10 that are activated in accordance with the rotation direction of the hydraulic motor 1. However, this invention may also be applied to a driving device for a unidirectional rotation type hydraulic motor, and in this case, the hydraulic motor driving device should include a single motor capacity change-over actuator 10 and a single flow control valve 15.

INDUSTRIAL FIELD OF APPLICATION

As described above, this invention brings about favorable effects in terms of alleviating a shock occurring during deceleration of a hydraulic motor used to generate travel power in a construction machine such as a hydraulic shovel.

The embodiments of this invention in which an exclusive property or privilege is claimed are defined as follows:

1. A hydraulic motor driving device that varies a capacity of a hydraulic motor using a working fluid, comprising:

a motor capacity change-over actuator, the motor capacity change-over actuator comprising a drive pressure chamber that varies the capacity of the hydraulic motor in accordance with supply and discharge of the working fluid;

a motor capacity change-over valve that changes between a supply position in which the working fluid is supplied to the drive pressure chamber and a discharge position in which the working fluid is discharged from the drive pressure chamber; and a flow control valve that is disposed between the drive pressure chamber and the motor capacity change-over valve to adjust a flow rate of the working fluid discharged from the drive pressure chamber, wherein the flow control valve is constituted by a pressure responsive variable orifice that narrows a flow sectional area of the working fluid as a working fluid pressure in the drive pressure chamber increases.

2. The hydraulic motor driving device as defined in claim 1, wherein the flow control valve comprises:

a housing;

a flow control spool that includes a cylindrical wall and a bottom portion and is accommodated in the housing to be free to slide;

a metering orifice that is formed to penetrate the bottom portion and communicates with the drive pressure chamber, the flow control spool sliding within the housing in accordance with a pressure loss of the metering orifice;

a through hole that penetrates the cylindrical wall to connect an inner side and an outer side of the flow control spool; and a passage formed in the housing (40, 70) to face the through hole, a flow sectional area between the through hole and the passage varying in accordance with a sliding position of the flow control spool.

3. The hydraulic motor driving device as defined in claim 2, wherein the flow control valve is built into the motor capacity change-over actuator.

4. The hydraulic motor driving device as defined in claim 3, wherein the hydraulic motor is constituted by a swash plate type hydraulic motor, the capacity of which is varied in accordance with a tilt angle of a swash plate, the motor capacity change-over actuator comprises a cylinder and a drive piston that is accommodated in the cylinder to be free to slide and supports the swash plate in a tilting direction, and the drive pressure chamber is formed on an inner side of the cylinder to face the drive piston.

5. The hydraulic motor driving device as defined in claim 4, wherein the housing is constituted by the drive piston, and the flow control spool is accommodated in the drive piston such that the drive pressure chamber faces the bottom portion.

6. The hydraulic motor driving device as defined in claim 5, further comprising a stopper that is fixed to the drive piston in order to restrict sliding of the flow control spool toward the drive pressure chamber.

7. The hydraulic motor driving device as defined in claim 2, wherein the hydraulic motor comprises a casing and a port block fixed to the casing, and the housing is constituted by the port block.

* * * * *